US005128586A

United States Patent [19]

Ashizaki et al.

[11] Patent Number: 5,128,586

[45] Date of Patent: Jul. 7, 1992

[54] COLOR CATHODE RAY TUBE GUN HAVING CONTROL GRID OF VARYING THICKNESS

[75] Inventors: Shigeya Ashizaki, Takatsuki; Masao Natsuhara, Ohtsu; Akira Hayashi, Suita, all of Japan

[73] Assignee: Matsushita Electronics Corporation, Osaka, Japan

[21] Appl. No.: 603,457

[22] Filed: Oct. 25, 1990

[30] Foreign Application Priority Data

Oct. 30, 1989 [JP] Japan ..... 1-283279
Jan. 29, 1990 [JP] Japan ..... 2-18360

[51] Int. Cl.[5] ..... H01J 29/51
[52] U.S. Cl. ..... 313/414; 313/457
[58] Field of Search ..... 313/414, 457

[56] References Cited

U.S. PATENT DOCUMENTS 4,242,613 12/1980 Brambring et al. ..... 313/447
4,251,747 2/1981 Burdick ..... 313/348
4,620,133 10/1986 Morrell et al. ..... 313/414 X

OTHER PUBLICATIONS

Y. Baima et al., Japanese Utility Model Publication No. 62-44448, Pub. Nov. 24, 1987.

*Primary Examiner*—Sandra L. O'Shea
*Attorney, Agent, or Firm*—Ratner & Prestia

[57] ABSTRACT

A shadow mask type color cathode ray tube fitted with an in-line type electron gun having a control grid of a quadrupole structure, wherein the control grid has an elongated rectangular hole having a horizontal diameter H and a vertical diameter V wherein the relationship expressed by $1 < H/V < 1.4$ is established.

2 Claims, 3 Drawing Sheets

COLOR CATHODE RAY TUBE GUN HAVING CONTROL GRID OF VARYING THICKNESS

BACKGROUND OF THE INVENTION

1. Field of the Invention

The present invention relates to a shadow mask type color cathode ray tube (CRT) including an in-line type electron gun that is provided with a control grid of a quatrupole structure.

2. Description of the Prior Art

Beam spots are produced on a phosphor screen of a color CRT by impinging an electron beam thereon. Since the beam spots form picture elements of the regeneration image, they should be diametrically small and as round in shape as possible. Otherwise, satisfactory resolution could not be attained. However, the deflection yoke incorporated in a color CRT with an in-line type electron gun is constructed so as to be capable of self-convergence, so that the electron beam is subjected to a horizontal deflection magnetic field in a pin-cushion shape and a vertical deflection magnetic field in a barrel shape. This causes the beams spots, particularly those in the periphery of the phosphor screen, to be distorted diametrically.

To overcome this problem, at least one of a control grid, an acceleration grid, and a focusing grid is modified so as to shape its electron-beam through-hole to be non-circular, thereby forming an astigmatic lens field. One example is a quadrupole type control grid, such as one which is disclosed in Japanese Utility Model Publication No. 62-44448. The resulting astigmatic lens field enables a passing electron beam through a deflection magnetic field to take a horizontally elongated rectangular shape in cross-section, and minimizes a virtual image of the cross-over section of the electron beam.

A disadvantage of the quadrupole type control grid is that if the vertical diameters of the beam spots become diametrically small, the scanning beam is likely to interfere with the apertures of the shadow mask, thereby producing fatal moire effects in the regeneration image. Such moire effects are most conspicuous in a low electric current zone such as in a range of a few $\mu$ A to a few tens $\mu$ A.

SUMMARY OF THE INVENTION

The shadow mask type color cathode ray tube (CRT) of this invention, which overcomes the above-discussed and numerous other disadvantages and deficiencies of the prior art, is fitted with an in-line type electron gun which comprises a control grid, an accelerating grid, a focusing grid, and a final accelerating grid, wherein the control grid has a main surface whose inside is provided with a metal plate including a horizontally elongated rectangular first hole having a horizontal diameter H and a vertical diameter V, the main surface has a vertically elongated rectangular second hole having a horizontal diameter substantially equal to the horizontal diameter of the first hole, the second hole being concentric of the first hole, wherein the relationship expressed by $1<H/V<1.4$ is established.

In a preferred embodiment, the control grid has a horizontally elongated rectangular first hole having a horizontal diameter H and a vertical diameter V toward the cathode of its main surface, the main surface having a vertically elongated rectangular second hole toward the acceleration grid, the second hole having a horizontal diameter substantially equal to the horizontal diameter of the first hole, the second hole being concentric of the first hole, wherein the relationship expressed by $1<H/V<1.4$ is established.

In a preferred embodiment, the acceleration grid has a thickness of $G_{2t}$, and is spaced from the focusing grid by a distance $G_{2\text{-}3}$, and wherein the relationships expressed by $1<G_{2t}/H<2$ and $1<G_{2\text{-}3}/H<2$ are established.

Thus, the invention described herein makes possible the objectives of providing a color cathode ray tube attaining high resolution, and having no possibility of moire effects in the regeneration images.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

The present invention will be described as an example with reference to a color cathode ray tube (29 inches, deflection angel: 110°).

Figure 1:
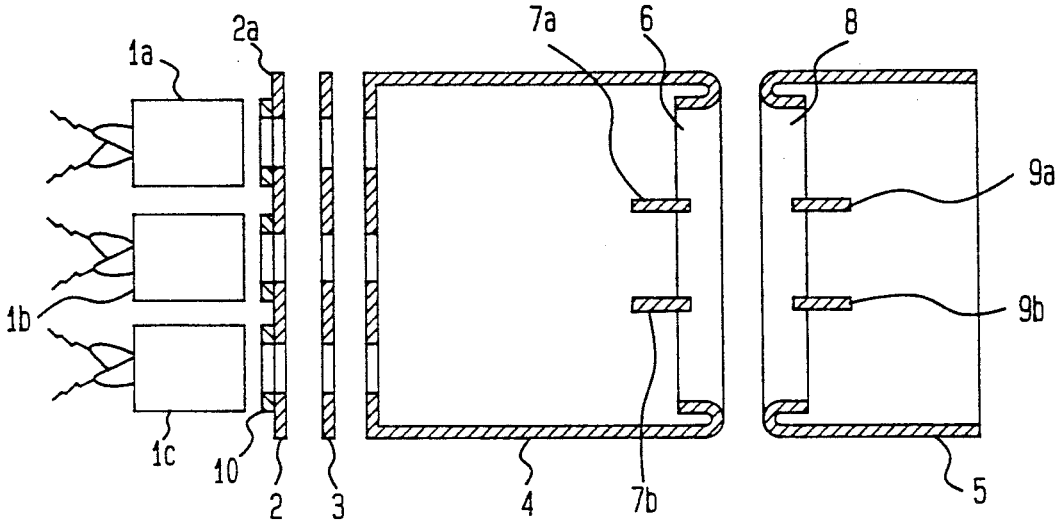
FIG. 1 is a cross-sectional view showing a color cathode ray tube according to the present invention.
Figure 2:
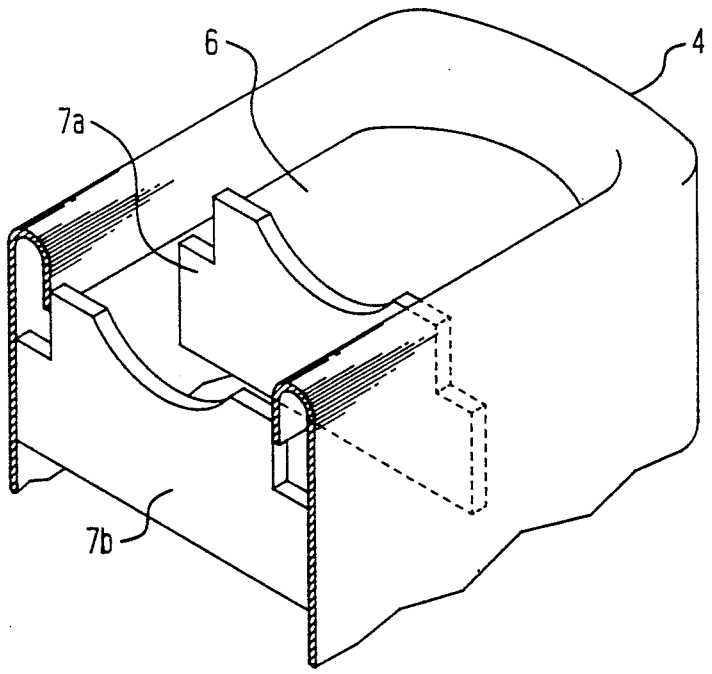
FIG. 2 is a partially broken perspective view showing of the electron gun.

FIG. 1 shows an in-line electron gun which includes three cathodes 1*a*, 1*b*, and 1*c* aligned horizontally in an in-line fashion, a control grid 2, an acceleration grid 3, a focusing grid 4, and an anode 5 as a final acceleration grid. As shown in FIG. 2, the electron gun is provided with a horizontally elongated hole 6 of that end face of the focusing grid 4 that faces toward the anode 5, the hole 6 being divided into three sections by metal plates 7*a* and 7*b* designed to adjust an electric field. As shown in FIG. 1, the electron gun has another horizontally elongated hole 8 on that end face of the anode 5 which faces toward the focusing grid 4. The hole 8 is also divided into three sections by metal plates 9*a* and 9*b* designed to adjust an electric field. The control grid 2 is provided with metal plates 10 on its inside surface 2*a* so as to form a quadrupole structure.

Figure 3A:
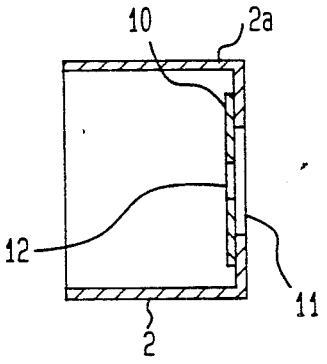
FIGS. 3(*a*) and (*b*) are a cross-sectional side view and a front view showing a control grid of the electron gun, respectively.
Figure 3B:
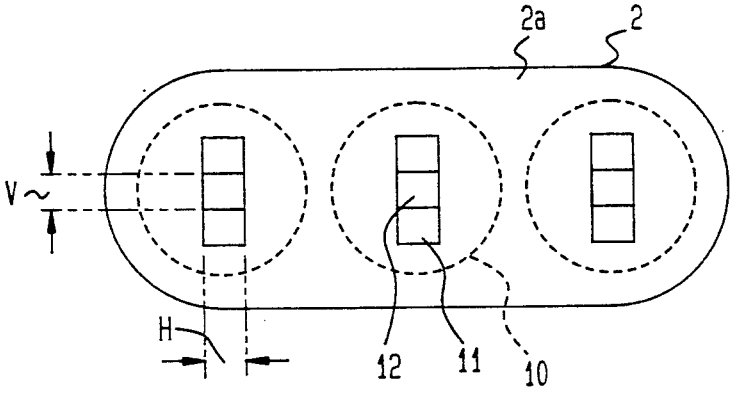

Referring to FIGS. 3*a* and 3*b*, the control grid 2 is provided with a vertically elongated rectangular hole 11 on its main surface 2*a*, and each metal plate 10 is provided with a horizontally elongated rectangular hole 12 concentric with the hole 11. The horizontal diameter H of the hole 12 is virtually equal to the horizontal diameter of the hole 11. The vertical diameter V of the hole 12 is smaller than the vertical diameter of the hole 11. In the illustrated example, each value was as follows:

Horizontal diameter (H) was 0.56 mm;

Vertical diameter (V) was 0.50 mm;

therefore, H/V was 1.12

All the three electron-beam through-holes aligned in an in-line fashion in the acceleration grid 3 are completely rounded, each having a diameter of 0.56 mm which is equal to the horizontal diameter H of the hole 12. All the three electron-beam through-holes aligned in an in-line fashion toward the focusing grid 4 are completely rounded, each having a diameter of 0.9 mm. The acceleration grid 3 has a thickness $G_{2t}$ of 0.8 mm. The distance $G_{1\text{-}2}$ between the control grid 2 and the acceleration grid 3 is 0.20 mm, and the distance $G_{2\text{-}3}$ between the acceleration grid 3 and the focusing grid 4 is 0.80 mm. Modulated voltage of 0 V to about 200 V is applied to each cathode, wherein the control grid is grounded. Then, voltage of about 600 V to 1200 V is applied to the acceleration grid 3, voltage of about 7 KV to 9 KV to the focusing grid 4, and voltage of about 25 KV to 35 KV to the anode 5.

Figure 4:
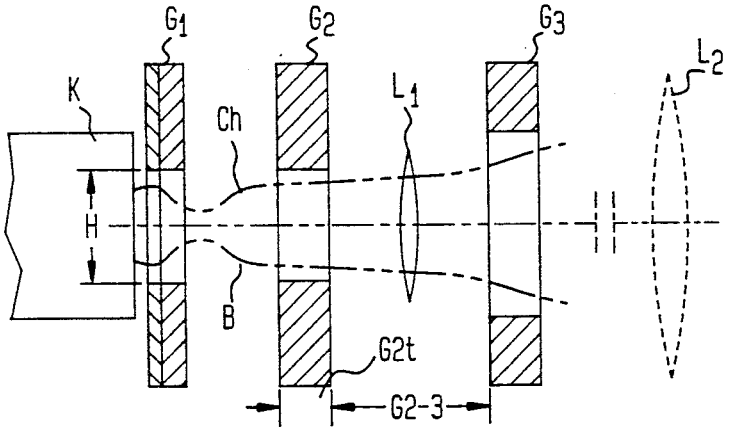
FIGS. 4 and 5 are a horizontal cross-section and a vertical cross-section each exemplifying the operation of an in-line type electron gun having the control grid of a quatrupole structure.
Figure 5:
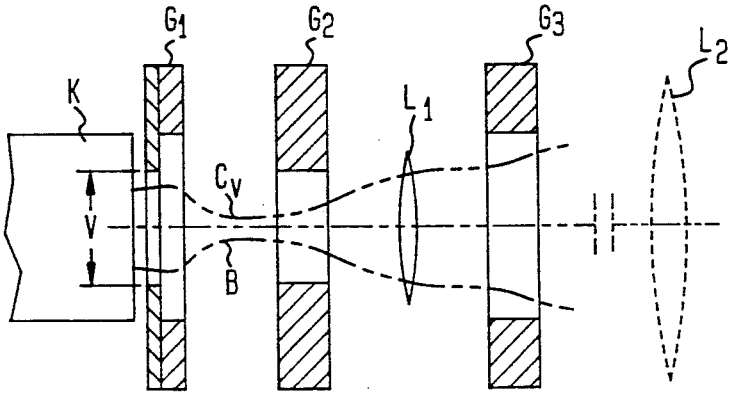
Figure 6:
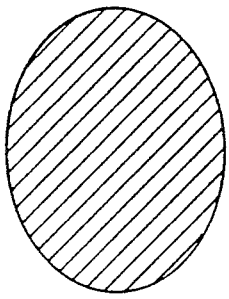
FIG. 6 is a view showing a pattern of a vertically distorted beam spot.

Referring to FIGS. 4 and 5, an example of the operation of the in-line type electron gun having the above-described quadrupole construction will be described:

FIGS. 4 and 5 are a horizontal cross-section and a vertical cross-section showing the mode of an electron beam when H/V is set to 1, respectively. As shown in FIG. 4, in the horizontal cross-section a cross-over Ch (hereinafter referred to the "horizontal-direction cross-over") of the electron beam B is generated near the control grid $G_1$, and as shown in FIG. 5, in the vertical cross-section the cross-over Cv (hereinafter referred to as the "vertical-direction cross-over") is generated near the acceleration grid $G_2$. In this mode the electron beam B is impinged on the phosphor screen through a prefocus lens field $L_1$ and the main lens field $L_2$, thereby generating beam spots thereon. Because of the self-convergence structure, the electron beam tends to be constantly focused irrespective of variations in the deflection angles. If the electron lens system is focused on the horizontal-direction cross-over $C_h$, the vertical-direction cross-over $C_v$ is deviated from the horizontal cross-over $C_h$ toward the main lens. As a result, the beam spots are vertically under-focused, presenting a vertically elongated shape as shown in FIG. 6. The resolution becomes low.

When H/V is set to 1.4, the vertical-direction cross-over $C_v$ comes near the horizontal-direction cross-over $C_h$, thereby equalizing the vertical diameter of the beam to the horizontal diameter thereof. The beam spots in the low current zone become too small in their vertical diameter, thereby generating moire effects.

Figure 7:
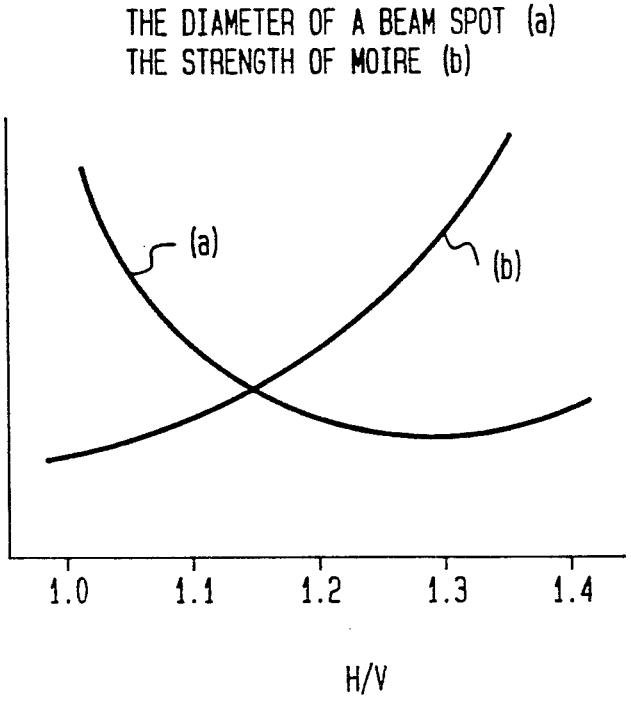
FIG. 7 is a graph depicting the relationship between the diameter of a beam spot and the strength of moire with respect to H/V.

In the illustrated embodiment the H/V was set to 1.12. As shown in FIG. 7, this value is located at the junction of a characteristic curve a representing the beam spot diameter and a characteristic curve b representing the intensity of moire effects. The junction of the two curves means a point of compromise between the diameter of the beam spot and the intensity of the moire effects, therefore the maintenance of this position avoids the production of moire effects without decreasing resolution.

Other factors are also important; one factor is the distance $G_{2\text{-}3}/H$, wherein the distance $G_{2\text{-}3}$ is between the acceleration grid $G_2$ and the focusing grid $G_3$. Another factor is $G_{2t}/H$, wherein the $G_{2t}$ is the thickness of the acceleration grid $G_2$. In the illustrated embodiment, $G_{2\text{-}3}/H$ was 1.43, and $G_{2t}/H$ was 1.43. It is preferred that the following conditions are satisfied:

$$1 < G_{2\text{-}3}/H < 2$$

$$1 < G_{2t}/H < 2$$

When $G_{2\text{-}3}/H$ is set to 1 or less, the prefocus lens becomes excessively strong, so that an electron beam generated from one cross-over produces another cross-over at a point near the prefocus lens in a low beam current zone. As a result, a just focus spot occurs around the peripheral portion of the phosphor screen, thereby allowing moire effects to appear. When $G_{2\text{-}3}/H$ is set to 2 or more, a blooming occurs in the same manner as when $G_{2\text{-}3}/H$ is set to 1 or less, or the beam spot is distorted in the peripheral portion of the phosphor screen.

When $G_{2t}/H$ is set to 1 or less, the electron beam in the large beam current zone is subjected to a spherical aberration of the main lens, and enlarges the diameter of the beam spot, thereby causing a blooming to occur. The beam spots, particularly in the peripheral portion of the phosphor screen, are likely to be distorted owing to a deflection. When $G_{2t}/H$ is set to 2 or more, the electron beam tends to become excessively small in diameter, and the lens has a larger magnification, thereby enlarging the diameter of the beam spots generated in the center of the phosphor screen.

Figure 8A:
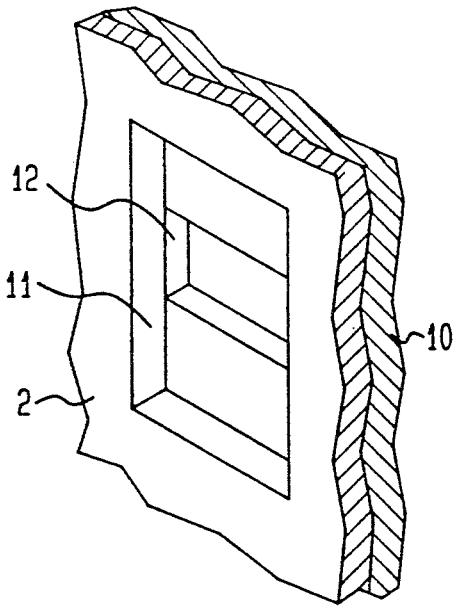
FIG. 8(*a*) and (*b*) are perspective views showing main portions of examples of a control grid incorporated in the in-line type electron gun.
Figure 8B:
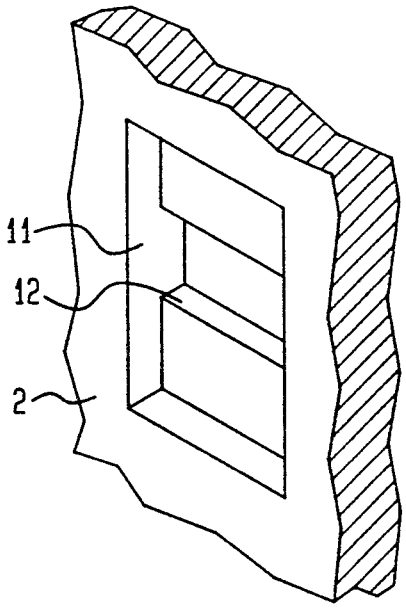

In the illustrated embodiment, the control grid 2 is provided with the metal plate 10 on its inside surface, and the metal plate 10 is provided with a two-stepped hole as shown in FIG. 8(*a*). Instead of using the metal plate 10, the two-stepped hole can be made directly in the control grid 2 by pressing it one time, as show in FIG. 8(*b*).

As is evident from the foregoing, the present invention makes it possible to keep adequate diameters of beam spots in the low beam current zone while keeping to minimize those in the high beam current zone, thereby producing high resolution without the possibility of causing moire effects.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A shadow mask type color cathode ray tube fitted with an in-line type electron gun which comprises a control grid, an accelerating grid, a focusing grid, and a final accelerating grid, wherein the control grid has a main surface whose inside is provided with a metal plate including a horizontally elongated rectangular first hole having a horizontal diameter H and a vertical diameter V, the main surface has a vertically elongated rectangular second hole having a horizontal diameter substantially equal to the horizontal diameter of the first hole, the second hole being concentric of the first hole, wherein the relationship expressed by $1 < H/V < 1.4$ is established, wherein the acceleration grid has a thickness of $G_{2t}$, and is spaced from the focusing grid by a distance $G_{2\text{-}3}$, and wherein the relationships expressed by $1<G_{2f}/H<2$ and $1<G_{2\text{-}3}/H<2$ are established.

2. A shadow mask type color cathode ray tube fitted with an in-line type electron gun, a control grid, an accelerating grid, a focusing grid, and a final accelerating grid, wherein the control grid has a horizontally elongated rectangular first hole having a horizontally diameter H and a vertical diameter V toward the vertically elongated rectangular second hole toward the acceleration grid, the second hole having a horizontal diameter substantially equal to the horizontal diameter of the first hole, the second hole being concentric of the first hole, wherein the relationship expressed by 1 H/V 1.4 of $G_{2f}$, and is spaced from the focusing grid by a distance $G_{2\text{-}3}$, and wherein the relationships expressed by $1<G_{2f}/H<2$ and $1<G_{2\text{-}3}/H<2$ are established.

* * * * *

UNITED STATES PATENT AND TRADEMARK OFFICE

CERTIFICATE OF CORRECTION

PATENT NO. : 5,128,586
DATED : July 7, 1992
INVENTOR(S) : Shigeya Ashizaki et al.

It is certified that error appears in the above-identified patent and that said Letters Patent is hereby corrected as shown below:

column 5, line 7, claim 2, change "horizontally" to --horizontal--.

column 5, line 8, claim 2, after "the" insert --cathode of its main surface, the main surface having a--.

column 6, line 4 & 5, claim 2, "1 H/V 1.4" should be --1<H/V<1.4--.

column 6, line 5, claim 2, after "1.4" insert --is established wherein the acceleration grid has a thickness--.

Signed and Sealed this

Eleventh Day of October, 1994

Bruce Lehman

*Attest:*

BRUCE LEHMAN

*Attesting Officer*

*Commissioner of Patents and Trademarks*